US005892394A

United States Patent [19]

Wu

[11] Patent Number: 5,892,394

[45] Date of Patent: Apr. 6, 1999

[54] INTELLIGENT BIAS VOLTAGE GENERATING CIRCUIT

[75] Inventor: Rong-Tyan Wu, Tai-Chung, Taiwan

[73] Assignee: Holtek Microelectronics Inc., Hsinchu, Taiwan

[21] Appl. No.: 717,069

[22] Filed: Sep. 20, 1996

[51] Int. Cl.[6] ..... G05I 3/02

[52] U.S. Cl. ..... 327/546; 327/313; 327/328; 327/543; 327/530

[58] Field of Search ..... 327/143, 312, 327/313, 314, 320, 321, 323, 325, 328, 333, 530, 541, 543, 545, 546

[56] References Cited

U.S. PATENT DOCUMENTS

| | | | |
|---|---|---|---|
| 4,317,055 | 2/1982 | Yoshida et al. | 327/541 |
| 4,691,123 | 9/1987 | Hashimoto | 327/546 |
| 5,083,043 | 1/1992 | Yoshida | 327/541 |
| 5,319,601 | 6/1994 | Kawata et al. | 327/143 |
| 5,321,653 | 6/1994 | Suh et al. | 327/541 |
| 5,382,839 | 1/1995 | Shinohara | 327/545 |
| 5,448,199 | 9/1995 | Park | 327/546 |
| 5,532,578 | 7/1996 | Lee | 327/538 |

*Primary Examiner*—Terry D. Cunningham
*Attorney, Agent, or Firm*—Tung & Associates

[57] ABSTRACT

An intelligent bias voltage generating circuit capable of providing an electronic device with a reliable bias signal includes a power input terminal which is electrically connected to a power generating device for providing a power input, and a bias voltage generating circuit which is electrically connected to the power input terminal for responding to power fluctuations and generating a bias voltage signal output by a multi-section linear variation method.

7 Claims, 3 Drawing Sheets

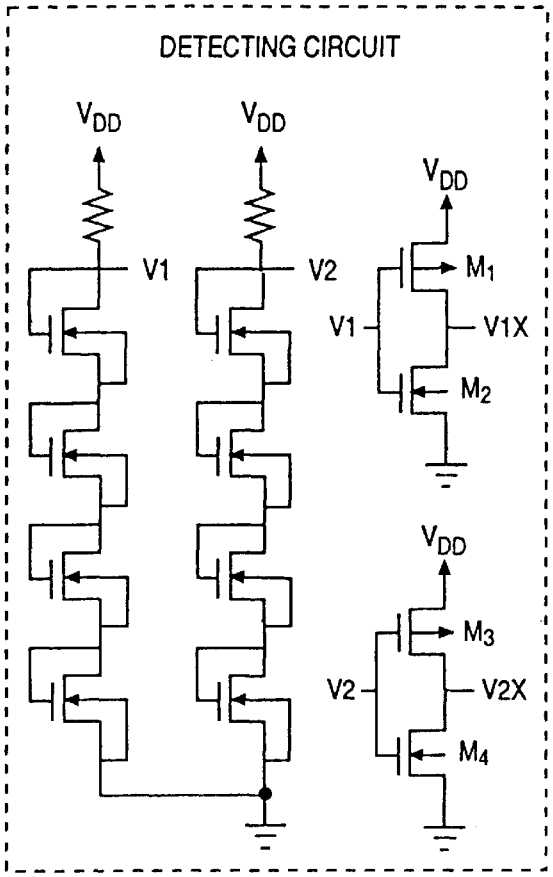
FIG.3A
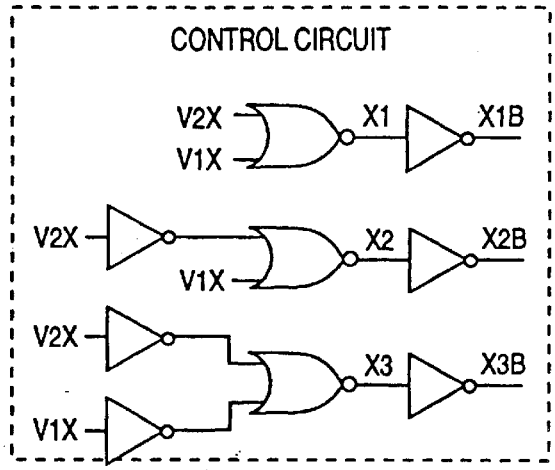
FIG.3B
FIG.3C
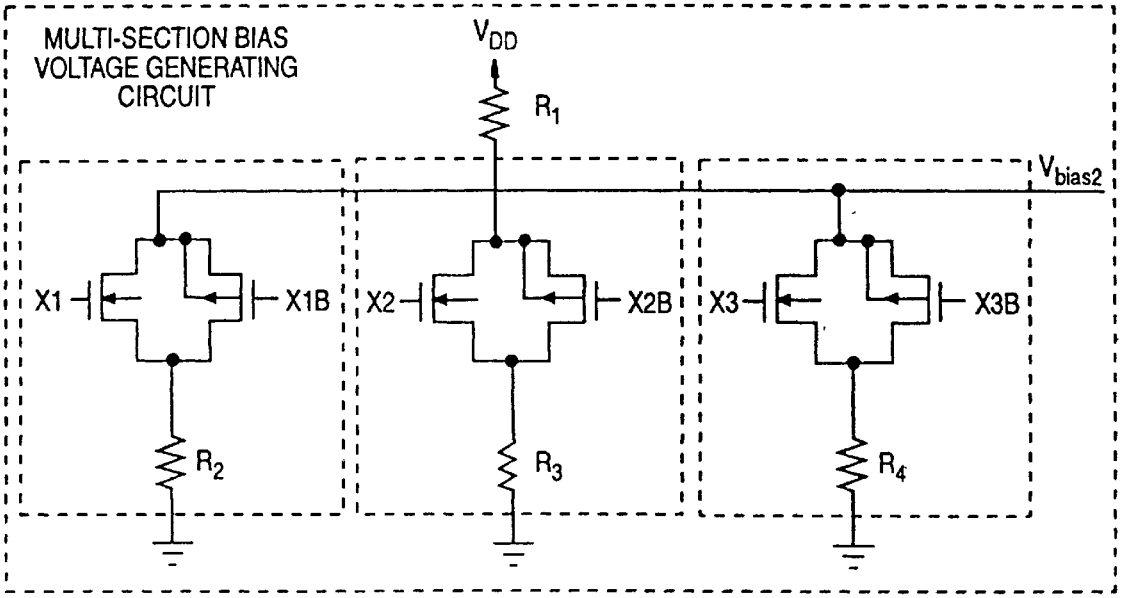

INTELLIGENT BIAS VOLTAGE GENERATING CIRCUIT

FIELD OF THE INVENTION

The present invention generally relates to a bias voltage generating circuit and more particularly, relates to an intelligent bias voltage generating circuit capable of producing a bias voltage signal in response to a power fluctuation by a multi-section linear variation method.

BACKGROUND OF THE INVENTION

In various electronic devices, the bias voltage generating circuit is widely used and plays an important role. The main function of a bias voltage generating circuit is to provide a stable bias voltage for the circuits downstream so that they can be operated smoothly. For example, a direct current bias voltage generating circuit which is electrically connected to a transistor provides a stable direct current bias signal so that the transistor can be operated within a working range, a saturation range, a cut-off range or any other operating range as desired.

A conventional bias voltage generating circuit has many drawbacks. It can be easily affected by power fluctuations or variations in the fabrication process and hence, it cannot perform the required functions of a bias voltage. It may even produce faulty signals and may not be capable of maintaining a bias voltage output in a usable range. To further illustrate the drawbacks of a conventional bias voltage generating circuit, an example which is frequently used in a reference voltage generating circuit is described below.

Referring initially to FIG. 1 which is a circuit diagram of a conventional bias voltage generating circuit that is used in a reference bias voltage generating circuit. The circuit includes a power generating device 1, a reference voltage generating device 2, and a bias voltage generating circuit 3. The power generating device is used to provide a power source $V_{DD}$ for the reference voltage generating circuit 2 and the bias voltage generating circuit 3. The bias voltage generating circuit 3 is a resistor type bias voltage generating circuit which includes bias resistors R1 and R2.

In FIG. 1, the bias voltage resistors R1, R2 and the equivalent resistance of the NMOS transistor (labeled as Q) enable a voltage division of power source $V_{DD}$. At the series connection point (labeled as P) of the bias resistors R1 and R2, a bias voltage output $V_{bias1}$ is generated for use by the reference voltage generating circuit 2. However, it is frequently affected by noise signals or other signals in the circuit such that it fluctuates. Consequently, a reliable bias voltage cannot be generated by the properly matched bias voltage resistors R1 and R2. In addition, although the NMOS transistor Q is used as an on/off switch (controlled by the Vcontrol signal), the equivalent resistance of the NMOS transistor Q fluctuates due to variations in the power source $V_{DD}$. It is therefore difficult to design a circuit to produce a desirable bias voltage. Furthermore, the bias voltage generated by a conventional bias voltage generating circuit varies greatly with variations in the power source $V_{DD}$ and drifts easily from a suitable working range.

Moreover, as shown in FIG. 1, a parallel connection between an input resistor Rin at point P of the reference voltage generating circuit 2 and the bias resistor R2 affects the value of the bias voltage $V_{bias1}$. Due to the difficulties in controlling manufacturing parameters and the variations in manufacturing time and environment, the characteristics of the components of the reference voltage generating circuit 2 and the bias resistors R1 and R2 can change. Such change can in turn change the input resistor Rin which is closely tied to the components in the reference voltage generating circuit 2, the bias resistors R1 and R2 and the equivalent resistance of the NMOS transistor Q. A drifting in the bias voltage $V_{bias1}$ can thus occur. The conventional bias voltage generating circuit easily drifts away from its originally designed working range due to changes occurred in the power source and in the component characteristics. It is not capable of producing a reliable bias voltage signal and moreover, it causes other circuits in the device to generate faulty signals and abnormal reactions.

It is therefore an object of the present invention to provide an intelligent bias voltage generating circuit which is capable of producing a reliable bias voltage that is not affected by fluctuations in the power source.

It is another object of the present invention to provide an intelligent bias voltage generating circuit which is capable of producing a reliable bias voltage that is not affected by changes in the component characteristics.

SUMMARY OF THE INVENTION

The present invention is related to an intelligent bias voltage generating circuit capable of providing an electronic device with a reliable bias signal. The intelligent bias voltage generating circuit includes a power input terminal which is electrically connected to a power generating device for providing a power input, and a bias voltage generating circuit which is electrically connected to the power input terminal for responding to power fluctuations and generating a bias voltage signal output by a multi-section linear variation method. The bias voltage generating circuit is capable of generating a bias voltage signal output in response to a large fluctuation in the power source. It can also generate different bias voltage signals in response to different power voltage requirements. As a result, a reliable bias voltage signal can be provided by the circuit.

BRIEF DESCRIPTION OF THE DRAWINGS

These and other objects, features and advantages of the present invention will become apparent from the following detailed description and the appended drawings in which:

FIGS. 3A~3C are detailed circuit diagrams for the bias voltage generating circuit utilized in the preferred embodiment of the present invention.

DETAILED DESCRIPTION OF THE PREFERRED EMBODIMENT

The present invention relates to an intelligent bias voltage generating circuit which is capable of producing a reliable bias voltage signal for an electronic device. The intelligent bias voltage generating circuit includes a power input terminal which is electrically connected to a power generating device for providing a power input, and a bias voltage generation circuit which is electrically connected to the power input terminal and is capable of responding to a power fluctuation for generating a bias voltage signal output by a multi-section linear variation method.

The bias voltage generating circuit includes a detecting circuit which is electrically connected to the power input terminal and capable of producing a power source status signal output in response to a power fluctuation; a control circuit which is electrically connected to the detecting circuit to output a plurality of sets of control signals in response to the power source status signal; and a multi-section bias voltage generating circuit which is electrically connected to the control circuit for generating a bias voltage signal output by a multi-section linear variation method in response to the plurality of sets of control signals.

The detecting circuit consists of a plurality of diode circuits. The diode circuit can be a diode component or an equivalent circuit of diodes formed by MOS transistors that are connected by diode connections. The detecting circuit can also be a band-gap reference type detecting circuit.

The control circuit includes a plurality of sets of logic gates for producing a compound number of sets of control signals. The circuit responds to the electrical potential of the power source status detection signal to enable one of the plurality of sets of logic gates to produce and output a corresponding control signal.

The multi-section bias voltage generating circuit includes a plurality of bias voltage generating circuits. It responds to the plurality of sets of control signals to enable one of the plurality of sets of bias voltage generating circuits to produce and output a corresponding bias voltage signal. The bias voltage generating circuit may include a bias voltage on/off control device. The bias voltage on/off control device may include a PMOS or NMOS transistor.

Figure 1:
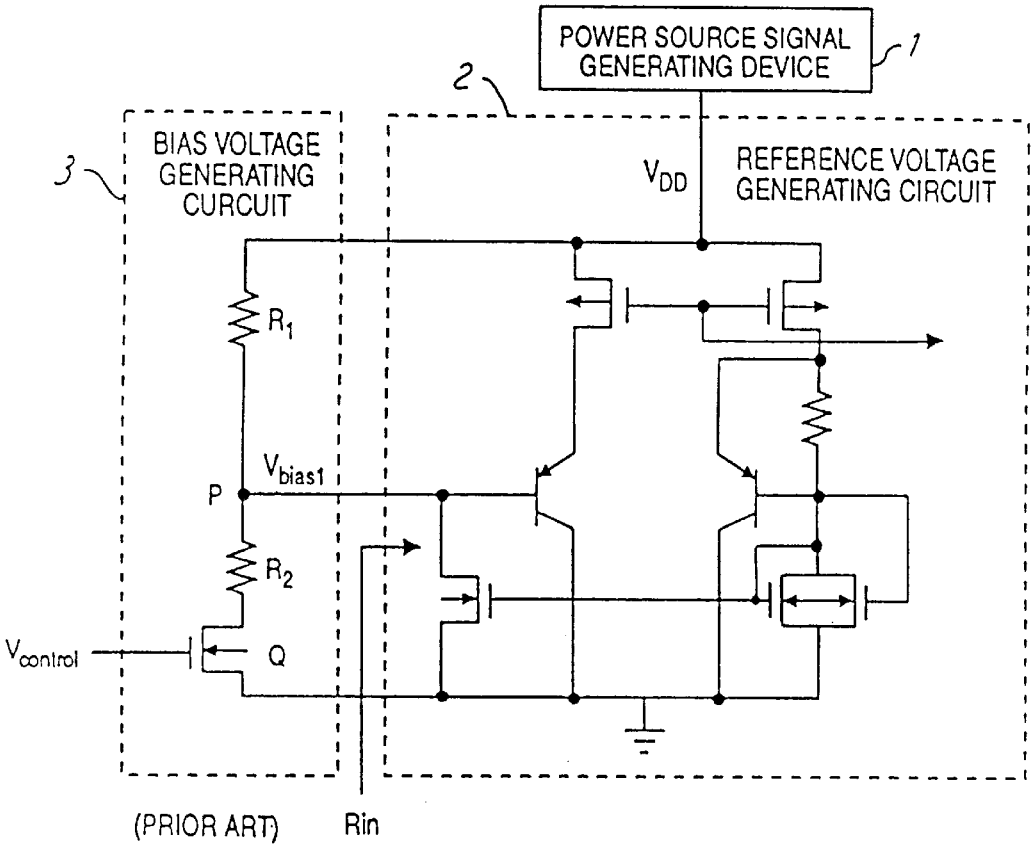
(PRIOR ART) FIG. 1
FIG. 1 is a circuit diagram for a conventional bias voltage generating circuit utilized in a reference voltage generating circuit application.
Figure 2:
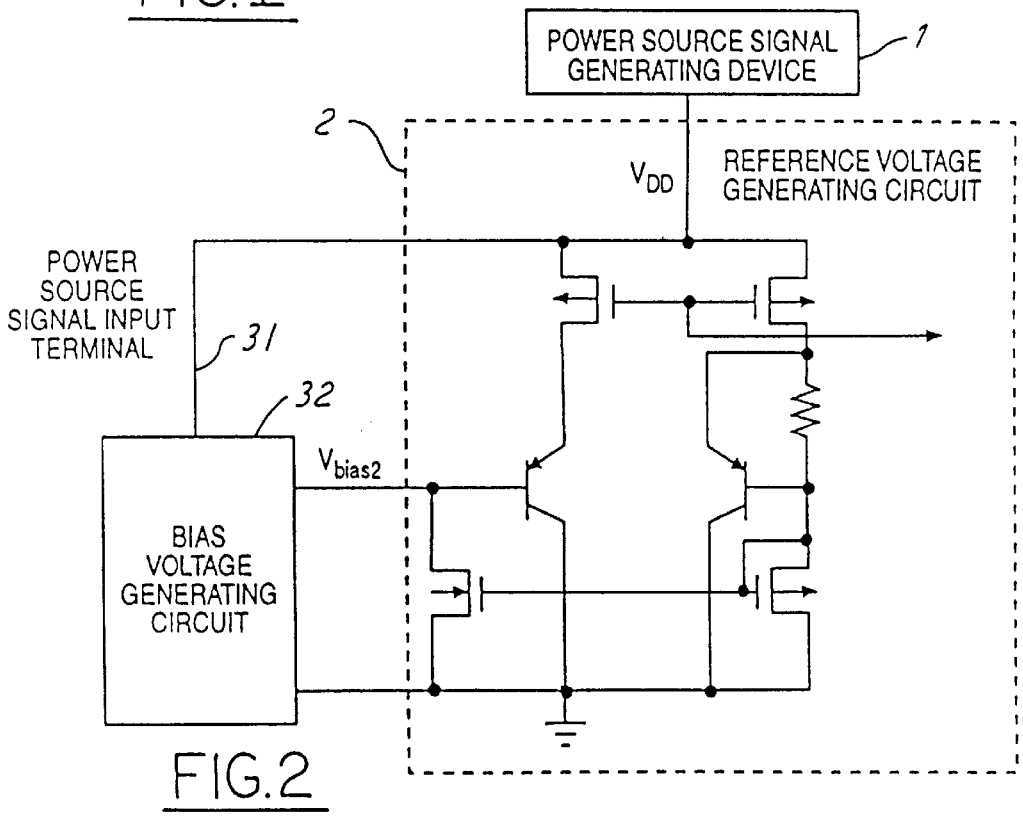
FIG. 2 is a circuit diagram for the preferred embodiment of the present invention bias voltage generating circuit utilized in a reference voltage generating circuit application.

Referring now to FIG. 2 where a circuit diagram for a preferred embodiment of the present invention utilized in a reference voltage generating circuit application is shown. The circuit contains a power source generating device 1, a voltage generating circuit 2, a power input terminal 31 and a bias voltage generating circuit 32. The power source generating device 1 provides a power source $V_{DD}$ for the reference voltage generating circuit 2 and the bias voltage generating circuit 32. The bias voltage generating circuit 32 generates a bias voltage signal $V_{bias2}$ by a multi-section linear variation method in response to a large fluctuation in the power source $V_{DD}$ or in the component characteristics of the reference voltage generating circuit 2, and then provides the reference voltage generating circuit 2 with an accurate bias voltage signal.

The bias voltage generating circuit 32 includes a detecting circuit 321, a control circuit 322 and a multi-section bias generating circuit 323. Detailed diagrams for the detecting circuit 321, the control circuit 322 and the multi-section bias voltage generating circuit 323 are shown in FIGS. 3A~3C.

In FIG. 3A, the detecting circuit 321 is constructed of an equivalent circuit of diodes formed by a plurality of MOS transistors that are connected by a method of diode connection. In response to a fluctuation in $V_{DD}$ which may be caused by a noise signal or when shifting to a different potential based on changes in the component characteristics, the detecting circuit outputs V1 and V2 signals and transmits to a first phase inverter and a second phase inverter in order to invert phases to a power source voltage detection output signal V1X and V2X. The first phase inverter is a complementary metal oxide semiconductor (CMOS) phase inverter constructed by a P-channel metal oxide semiconductor (PMOS) transistor M1 and a N-channel metal oxide semiconductor (NMOS) M2. The second phase inverter is a CMOS phase inverter constructed by a PMOS transistor M3 and a NMOS M4. The transfer point of the above described inverters can be properly adjusted to improve the circuit reliability.

The power source voltage detection signals V1X and V2X are then outputted to the control circuit 322. This is shown in FIG. 3B. The three sets of logic gates, responding to the potentials of the power source status detection signals V1X and V2X, generate three sets of control signal outputs (X1, X1B), (X2, X2B) and (X3, X3B). Each logic gate circuit can be constructed by several NOR gates and inverter gates.

The three sets of control signals (X1, X1B), (X2, X2B) and (X3, X3B) are then outputted to the multi-section bias voltage generating circuit 323. This is shown in FIG. 3C. The multi-section bias voltage generating circuit 323 contains three sets of bias voltage generator circuits 3231, 3232 and 3233. Each bias voltage generating circuit may include a bias on/off control device that consists of a PMOS or a NMOS transistor. The bias resistors are labeled as R1~R4.

In the three sets of signals (X1, X1B), (X2, X2B) and (X3, X3B), only one can be enabled. Therefore, the three sets of bias voltage generating circuits 3231, 3232 and 3233 respond to one of the three sets of control signals (X1, X1B), (X2, X2B) and (X3, X3B) which has the enabling function, and generate and output a corresponding bias voltage signal to improve the drift phenomenon of the bias voltage signal $V_{bias2}$ caused by the different potentials of the power source $V_{DD}$.

For further illustration, when control signal (X1, X1B) is enabled, it flows through the bias voltage generating circuit 3231. The bias voltage signal $V_{bias2}$ is then:

$$(R2/(R1+R2))*V_{DD};$$

Similarly, if either control signal (X2, X2B) or (X3, X3B) is enabled, the bias voltage signal $V_{bias2}$ is:

$$(R3/(R1+R3))*V_{DD}$$

and $$(R4/(R1+R4))*V_{DD}, \text{ respectively.}$$

Additionally, in reference to the previously described detecting circuit 321, the circuit can be better constructed by a diode transistor circuit which is a combination of a plurality of diodes or by a band-gap reference type detection circuit.

Figure 4:
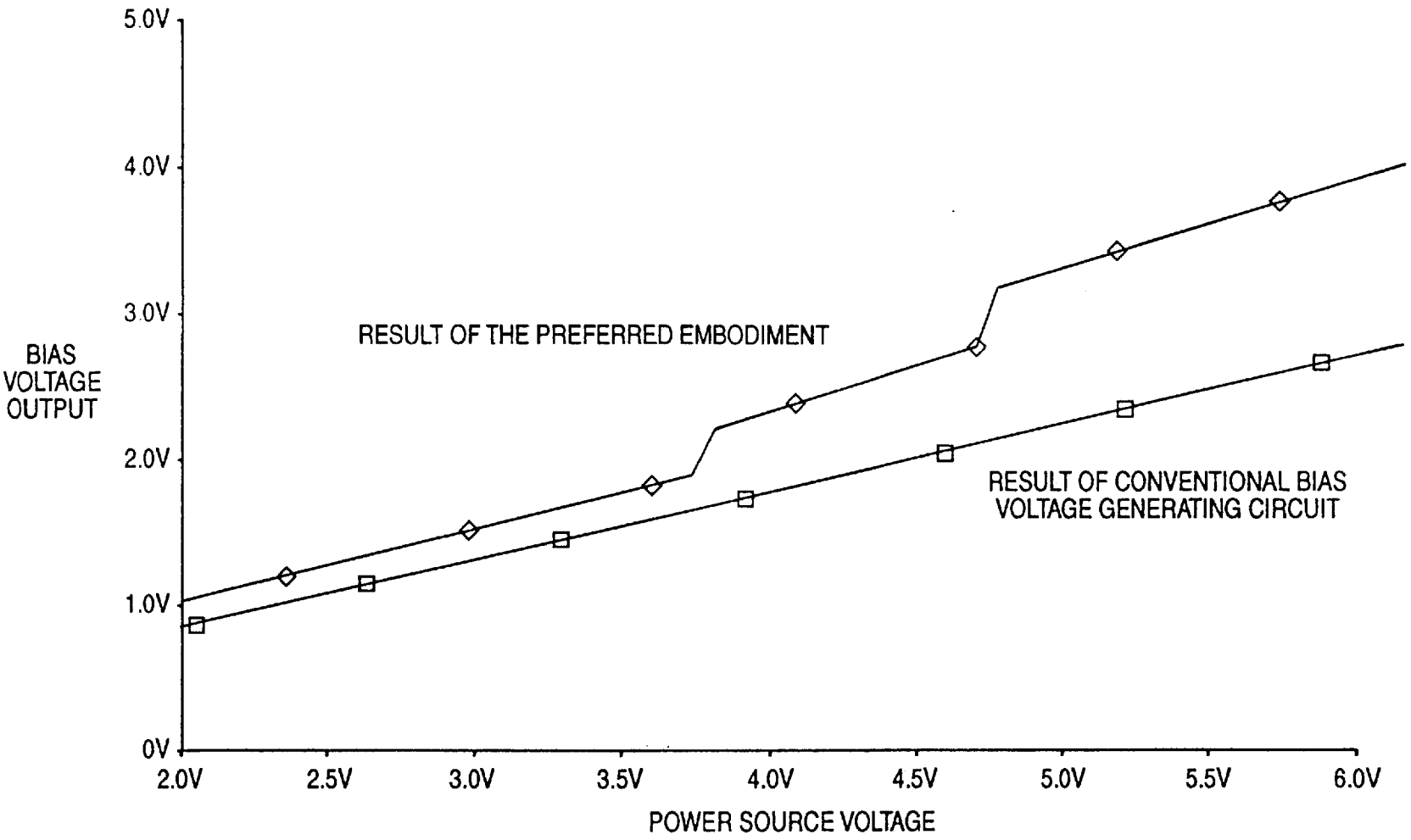
FIG. 4 is a graph illustrating the dependencies of the bias voltage output on the power source voltage for the preferred embodiment of the present invention and for the conventional bias generating circuit of FIG. 1.

The advantages made possible by the present invention is shown in FIG. 4 where the dependencies of the bias voltage output on the power source voltage for the present invention circuit and for the conventional method are shown. FIG. 4 shows that the bias voltage generating circuit 32 utilized in the preferred embodiment of the present invention responded readily to the power source $V_{DD}$ fluctuations by generating an output of a multi-section linear variation bias voltage signal.

The present invention circuit overcomes large bias voltage signal fluctuations caused by uncontrollable factors such as variations in the characteristics of the device components. Furthermore, large scale corrections due to power source variations can be automatically performed to produce more accurate outputs of bias voltage signals.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A circuit for generating a bias voltage for an electronic device, said bias voltage generating circuit comprising:

a detecting circuit;

a control circuit; and a multi-section bias voltage generating circuit comprising a plurality of bias voltage generating sections;

said detecting circuit being fed by a power source signal and producing output signals in response to power fluctuations;

said control circuit generating control signals in response to said output signals, said control signals being applied to said multi-section bias voltage generating circuit alternately, such that only one of said sections is active at a given time;

said multi-section bias voltage generating circuit producing said bias voltage, an amplitude of said bias voltage depending on which section of said multi-section bias voltage generating circuit is active.

2. A circuit according to claim 1, wherein said detection circuit further comprises a plurality of diode circuits.

3. A circuit according to claim 2, wherein each diode circuit is of said plurality of diode circuits an equivalent circuit of diodes formed by MOS transistors that are connected by diode connection.

4. A circuit according to claim 1, wherein said control circuit further comprises a plurality of logic gates for producing a plurality of sets of control signals capable of responding to the potential of said power source status detection signal and enabling one of said compound number of sets of logic gates to produce and output a corresponding control signal.

5. A circuit according to claim 1, wherein each section of said multi-section bias voltage generating section circuit comprises a plurality of bias voltage generating circuits capable of responding to said plurality of control signals and enabling one of said plurality of bias voltage generating circuits to produce and output a corresponding bias voltage signal.

6. A circuit according to claim 5, wherein each bias voltage generating circuit of said plurality of bias voltage generating circuits comprises an on/off control device.

7. A circuit according to claim 6, wherein said on/off control device comprises a PMOS or a NMOS transistor.

* * * * *